United States Patent [19]

T'jampens et al.

[11] 4,039,879

[45] Aug. 2, 1977

[54] ELECTRIC TUNGSTEN/BROMINE CYCLE LAMP AND METHOD OF MANUFACTURING SAID LAMP

[75] Inventors: Germain Remi T'jampens; Henricus Franciscus Johannes Giller, both of Eindhoven, Netherlands

[73] Assignee: U.S. Philips Corporation, New York, N.Y.

[21] Appl. No.: 729,928

[22] Filed: Oct. 6, 1976

[30] Foreign Application Priority Data

Oct. 7, 1975 Netherlands ..... 7511741

[51] Int. Cl.[2] ..... H01J 9/38; H01K 1/50

[52] U.S. Cl. ..... 313/174; 313/222; 313/223; 316/20

[58] Field of Search ..... 313/222, 174, 223; 316/20

[56] References Cited

U.S. PATENT DOCUMENTS

| | | | |
|---|---|---|---|
| 3,898,500 | 8/1975 | Johnston et al. | 313/222 X |
| 3,912,961 | 10/1975 | Rees et al. | 313/222 X |

*Primary Examiner*—Palmer C. Demeo

*Attorney, Agent, or Firm*—Frank R. Trifari; Robert S. Smith

[57] ABSTRACT

Electric tungsten/bromine cycle lamps are provided according to the invention with 2,2-diamino-4,4,6,6-tetrabromo-2,2,4,4,6-hexahydrotriazaphosphine, 2-amino-2,4,4,6,6-pentabromo-2,2,4,4,6,6-hexahydrotriazaphosphine or mixtures thereof as a phosphorusbromine-hydrogen source. It has been found that these non-corrosive compounds present a very flexible possibility for dosaging the various types of lamps.

2 Claims, 1 Drawing Figure

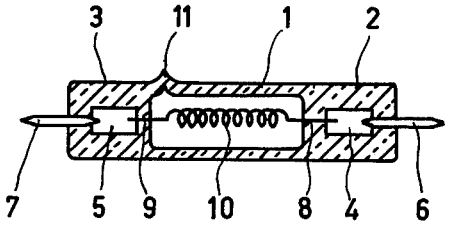
3
11
1
2
7
5
9
10
8
4
6

ELECTRIC TUNGSTEN/BROMINE CYCLE LAMP AND METHOD OF MANUFACTURING SAID LAMP

The invention relates to an electric tungsten/bromine cycle lamp in which a tungsten filament is positioned in a light-pervious lamp vessel which contains an inert gas, bromine, hydrogen and phosphorus.

Such a lamp is known from German Offenlegungsschrift No. 2,303,967. The lamp contains phosphorus to bind small quantities of oxygen which are present in the lamp in spite of observing great care in the manufacture of the lamp. With the hydrogen provided intentionally in the lamp, oxygen would start the water cycle which results in an accelerated transport of tungsten from the filament to the wall. In addition, oxygen would accelerate the attack of comparatively cold tungsten parts of the lamp by bromine.

The known lamp contains hydrogen to reduce the quantity of free bromine present in the lamp by the formation of hydrobromic acid and hence suppress the attack of comparatively cold tungsten parts.

According to the said Offenlegungsschrift, phosphorus is provided in the lamp vessel as such or as $WP_2$ or $P_3N_5$. Hydrogen and bromine are dosed as hydrobromic acid, possibly with the addition of hydrogen. The drawback of the use of hydrobromic acid is that due to the agressivity of the material, special corosion-resistant apparatus must be used in manufacturing the lamp.

From British Patent No. 1,236,174 it is known to provide phosphorus and bromine in a lamp vessel as $(PNBr_2)_n$, in which $n = 3$ or 4. These compounds would decompose during operation of the lamp and the formed bromine would start to maintain a transport cycle, while phosphorus would start to exert a gettering effect. In addition, phosphorus, like hydrogen, would inhibit the reaction between tungsten and bromine. According to this Patent Specification, $(PNBr_2)_n$ has the advantage of being not corrosive.

It has now been found that phosphorus is not an effective binder of bromine and that as a result of this a quantity of $(PNBr_2)_n$ lying within narrow limits must be dosed to obtain a readily operating lamp: when the dose is too small, the lamp vessel will blacken; when the dose is too high, the end of life of the lamp is reached as a result of attack of the colder tungsten parts. When $(PNBr_2)_n$ is used, readily operating lamps can be manufactured only if highly loaded and hence short-life lamps are concerned and the bromine compound is accurately dosed. In such lamps which have filament temperatures of, for example, 3300° K, such a rapid evaporation of tungsten of the filament occurs that in spite of the tungsten/bromine cycle the filament fuses in the hottest places before the attack of colder tungsten parts has progressed so that the end of the life of the lamp is achieved as a result of that. (For further explanation it is to be noted that although the tungsten-bromine cycle transports evaporated tungsten back to the filament, this is not mainly done to that site - the hottest - where most tungsten evaporates. The hottest site thus becomes thinner and thinner and hence hotter and hotter). In less highly loaded lamps, for example having filament temperatures of 2900° K, the attack of the colder tungsten part occurs more rapidly than the evaporation of tungsten from the hottest site. These lamps achieve end of life as a result of attack of the colder tungsten part at an instant which is prior to the instant at which the filament would fuse in the hottest site.

It is the object of the invention to provide tungsten/bromine cycle lamps which comprise a non-corrosive bromine compound so that no special requirements need be imposed upon the corrosion resistivity of the manufacturing apparatus and in which the quantity of the bromine compound is little or not critical.

In agreement herewith the invention relates to a tungsten/bromine cycle lamp of the kind mentioned in the preamble which is characterized in that the envelope contains 2,2-diamino-4,4,6,6-tetrabromo-2,2,4,4,6,6-hexahydrotriazaphosphine, 2-amino-2,4,4,6,6,-pentabromo 2,2,4,4,6,6-hexahydrotriaza-phosphine, mixtures thereof or their thermal decomposition products.

The first mentioned substance $P_3N_5H_4Br_4$ is known from J. Inorg. Nucl. Chem. 35 737 (1973); the second substance $P_3N_4H_2Br_5$ can be obtained in analogy with $P_3N_4H_2Cl_5$ (id. 29,2731 (1767)).

These compounds are solids at room temperature and, when provided in the lamp, decompose when the lamp is ignited and give hydrobromic acid. In addition the second material also gives free bromine.

The dosing of the compounds is particularly little critical. In lamps having a long desired life, $P_3N_5H_4Br_4$ will mainly be used, since in this substance a hydrogen atom is available for each bromine atom for the formation of hydrobromic acid which does not attack colder tungsten parts. As will be demonstrated hereinafter a very large spread in dosage is permissible when this substance is used.

In lamps having a comparatively short planned life in which a faster back transport of tungsten to the filament is required and a faster attack of the colder tungsten parts is permissible without this ending the life of the lamp, $P_3N_4H_2Br_5$ will mainly be used. This material also permits a considerable spread in dosage since in the case in which bromine is withdrawn from the cycle - for example as a result of the formation of a bromide of an impurity originating from the filament - bromine becomes available again for the cycle by dissociation of the hydrogen bromide formed in the decomposition of the substance.

This is in contrast with the dosing of bromine or $(PNBr_2)_n$, in which on the one hand the dosage may not be too large, and on the other hand must be sufficiently large to ensure a ready operation of the cycle even though a part of the bromine is withdrawn from the cycle during operation.

In short-life lamps, mixtures of $P_3N_4H_2Br_5$ and $P_3N_5H_4Br_4$ may also be used. According as the calculated life of lamps is longer, the quantity of $P_3N_5H_4Br_4$ in mixtures will be increased.

As a rule, a simple series of experiments is sufficient to establish the dosage of one or both substances desired for each type of lamp.

In the lamps according to the invention the phosphorus serves as an oxygen getter. In this respect the dosage of the substances is not critical either.

The invention also relates to a method of manufacturing an electric tungsten/bromine cycle lamp having a tungsten filament in a light-previous lamp vessel which contains an inert gas, bromine, hydrogen and phosphorus, characterized in that a solution of a substance selected from the group consisting of 2,2-diamino-4,4,6,6-tetrabromo-2,2,4,4,6,6-hexahydrotriazaphosphine, 2-amino-2,4,4,6,6-pentabromo-2,2,4,4,6,6-hexahydrotriazaphosphine and mixtures thereof are provided in the lamp vessel via an aperture in the wall of the lamp vessel, the solvent is evaporated, the lamp vessel is filled with an inert gas and is then sealed.

As solvents are to be considered organic solvents, preferably volatile solvents, for example benzene, toluene, petroleum ether, acetonitrile.

The lamp vessel may be manufactured from transparent materials which can withstand high temperatures, for example, quartz glass and kinds of glass having a lower $SiO_2$ content, for example "Vycor" ("Vycor" is a registered trade mark) and kinds of glass which are impervious to hydrogen, for example alumino-boro-silicate glass.

The invention will be described in greater detail with reference to the figure and a few embodiments.

The FIGURE shows a 12V/55W $H_1$ motorcar lamp.

In the FIGURE a cylindrical lamp vessel 1 of quartz glass is sealed at either end by means of pinched seals (2 and 3) in which molybdenum foils (4 and 5) are incorporated and to which external current conductors (6 and 7) and the ends (8 and 9) of the filament 10 are connected in an electrically conductive manner. At the end of the manufacturing process the lamp vessel is sealed at 11. The lamp vessel has a volume of 0.27 $cm^3$, an internal length of 10 mm and an inside diameter of 6 mm.

EXAMPLES

1. Lamps as shown in the FIGURE but having an exhaust tube at 11 were manufactured in the usual manner. They were provided with a quantity of a solution of 50 mg of $P_3N_5H_4Br_4$ in 100 ml of benzene. The solvent was evaporated. The lamps were evacuated to a pressure of $10^{-3}$ torr. The lamps were then filled with 1.5 atmosphere krypton and sealed at 11. The lamps were operated at design voltage, a filament temperature of 3200° K being reached.

The life of lamps having varying dosages of $P_3N_5H_4Br_4$ is stated in the following table. End of life was reached in all cases as a result of fusion of the filament in the hottest site, while the lamp vessels were bright.

It is to be noted that the krypton pressure in said experimental lamps is lower than the usual pressure: approximately 3,5 atm. This was voluntarily done so as to be able to establish possible differences in life as a result of varying dosages after a comparatively short period in operation.

| $\mu$ g $P_3N_5H_4Br_4$ | Life hr. |
|---|---|
| 10.2 | 275 |
| 17 | 265 |
| 34 | 180 |
| 51 | 220 |
| 85 | 220 |
| 170 | >180 |

In order to find out the influence of the presence of oxygen on the operation of the tungsten/bromine cycle a number of lamps were manufactured to which 1, 2 or 3 Torr oxygen were added in addition to $P_3N_5H_4Br_4$ and krypton.

| $\mu$ g $P_3N_5H_4Br_4$ | torr $O_2$ | life hr |
|---|---|---|
| 17 | 1 | 240 |
| 34 | 1 | 320 |
| 51 | 1 | 280 |
| 85 | 1 | 285 |
| 17 | 2 | 290 |
| 17 | 3 | 275 |

No deviations in the lamp were visible. All the lamps, with bright envelope, fused in the hottest place of the filament.

These experiments prove on the one hand that a large variation in the dosed quantity of the phosphorus hydrobromic acid source is permissible, on the other hand that oxygen is effectively made harmless.

2. Photolamps of 225 V/1000 W, inside diameter 7.5 mm, internal length 90 mm, similar to the lamp of the FIGURE, were provided with a phosphorus/-bromine/hydrogen source in accordance with the method described in example 1. The lamps were evacuated and filled with a mixture of 92% by volume of argon and 8% by volume of nitrogen to a pressure of 700 Torr. The exhaust tubes were tipped off and the lamps were operated at design voltage. The colour temperature of the filament was 3400° K.

A first series of lamps was provided with 0.590$\mu$mol of $P_3N_4H_2Br_5$, a second series with 0.496$\mu$mol of $P_3N_4H_2Br_5$ plus 0.116$\mu$mol of $P_3N_5H_4Br_4$ and a third series with 0.325$\mu$mol of $P_3N_4H_2Br_5$ plus 0.325$\mu$mol of $P_3N_5H_4Br_4$. For all the lamps it holds that they fused in the hottest site after approximately 20 hours in operation while the envelope was bright. Thus in none of the lamps was the end of life caused by attack of cold ends.

What is claimed is:

1. An electric tungsten/bromine cycle lamp in which a tungsten filament is positioned in a light-pervious lamp vessel which contains an inert gas, bromine, hydrogen and phosphorus, characterized in that the envelope contains 2,2-diamino-4,4,6,6-tetrabromo-2,2,4,4,6,6-hexahydrotriazaphosphine, 2-amino-2,4,4,6,6-pentabromo-2,2,4,4,6,6-hexahydrotriazaphosphine, mixtures thereof or thermal decomposition products thereof.

2. A method of manufacturing an electric tungsten/-bromine cycle lamp having a tungsten filament in a light-pervious lamp vessel which contains an inert gas, bromine, hydrogen and phosphorus, characterized in that a solution of a substance selected from the group consisting of 2,2-diamino-4,4,6,6-tetrabromo-2,2,4,4,6,6-hexahydrotriazaphosphine, 2-amino-2,4,4,6,6-pentabromo-2,2,4,4,6,6-hexahydrotriazaphosphine and mixtures thereof is provided in the lamp vessel via an aperture in the wall of the lamp vessel, the solvent is evaporated, the lamp vessel is filled with an inert gas and is then sealed.

* * * * *

UNITED STATES PATENT OFFICE

CERTIFICATE OF CORRECTION

Patent No. 4039879 Dated August 2, 1977

Inventor(s) Germain R. T'Jampens et al

It is certified that error appears in the above-identified patent and that said Letters Patent are hereby corrected as shown below:

In the Abstract, Line 3, delete "2,2,4,4,6 hexahydrotriazaphosphine" and insert

--2,2,4,4,6,6-hexahydrotriazaphosphine--.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*